US007395852B1

(12) United States Patent
Gurin

(10) Patent No.: US 7,395,852 B1
(45) Date of Patent: Jul. 8, 2008

(54) ENHANCED ENERGY CONCENTRATOR COMPOSITION

(76) Inventor: Michael H Gurin, 4132 Cove La., Unit A, Glenview, IL (US) 60025

( * ) Notice: Subject to any disclaimer, the term of this patent is extended or adjusted under 35 U.S.C. 154(b) by 240 days.

(21) Appl. No.: 10/904,463

(22) Filed: Nov. 11, 2004

Related U.S. Application Data

(60) Provisional application No. 60/519,804, filed on Nov. 14, 2003.

(51) Int. Cl.
*F28F 7/00* (2006.01)

(52) U.S. Cl. ..... 165/148; 977/779; 977/833; 165/133; 165/185

(58) Field of Classification Search ..... 165/133, 165/148, 109.1, 185; 361/705; 977/779, 977/833

See application file for complete search history.

(56) References Cited

U.S. PATENT DOCUMENTS

| | | | | |
|---|---|---|---|---|
| 5,466,431 | A * | 11/1995 | Dorfman et al. | 423/446 |
| 5,965,036 | A * | 10/1999 | Maki et al. | 216/106 |
| 5,989,459 | A * | 11/1999 | Nguyen et al. | 252/503 |
| 6,081,425 | A * | 6/2000 | Cheng | 165/185 |
| 6,374,909 | B1 * | 4/2002 | Jeter et al. | 165/96 |
| 6,390,181 | B1 * | 5/2002 | Hall et al. | 165/80.3 |
| 6,402,464 | B1 * | 6/2002 | Chiu et al. | 165/133 |
| 6,426,020 | B1 * | 7/2002 | Okada et al. | 252/79.1 |
| 6,598,781 | B2 * | 7/2003 | Hasz et al. | 228/245 |
| 6,849,109 | B2 * | 2/2005 | Yadav et al. | 106/31.13 |
| 2002/0079089 | A1 * | 6/2002 | Kang et al. | 165/84 |
| 2003/0151030 | A1 * | 8/2003 | Gurin | 252/502 |
| 2005/0230822 | A1 * | 10/2005 | Tran | 257/735 |
| 2005/0256240 | A1 * | 11/2005 | Nelson | 524/430 |
| 2006/0089442 | A1 * | 4/2006 | Mennig et al. | 524/430 |

FOREIGN PATENT DOCUMENTS

| | | | |
|---|---|---|---|
| WO | WO 00/69955 | * | 11/2000 |

* cited by examiner

*Primary Examiner*—Teresa J. Walberg

(57) ABSTRACT

A thermal concentrator composition with optimized design and reduced thermal resistance as a means of enhancing heat transfer and energy conversion. The composition comprises a low thermal resistance coating and methods of achieving quantum regions of energy transfer and non-linear design features resulting from cost effective manufacturing methods applicable to the material composition. The thermal concentrator composition is selected principally from the group of surface coatings, preferably comprised of diamond coatings, which are critical to obtaining maximum thermal transfer through classical and such quantum means including tunneling, waves, and phonon conversions.

15 Claims, 3 Drawing Sheets

*Cross-sectional View*

Figure I
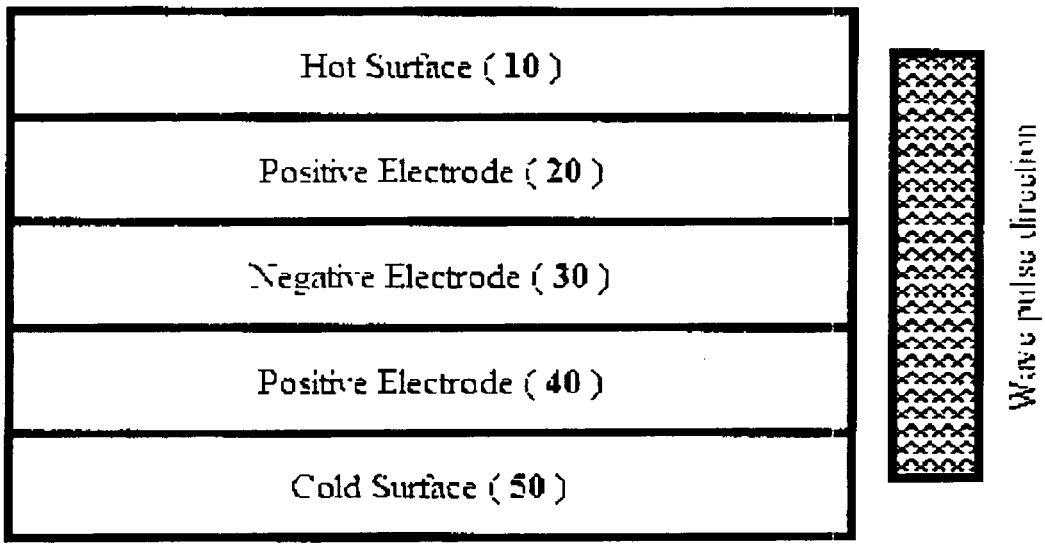
*Cross-sectional View*

Figure II
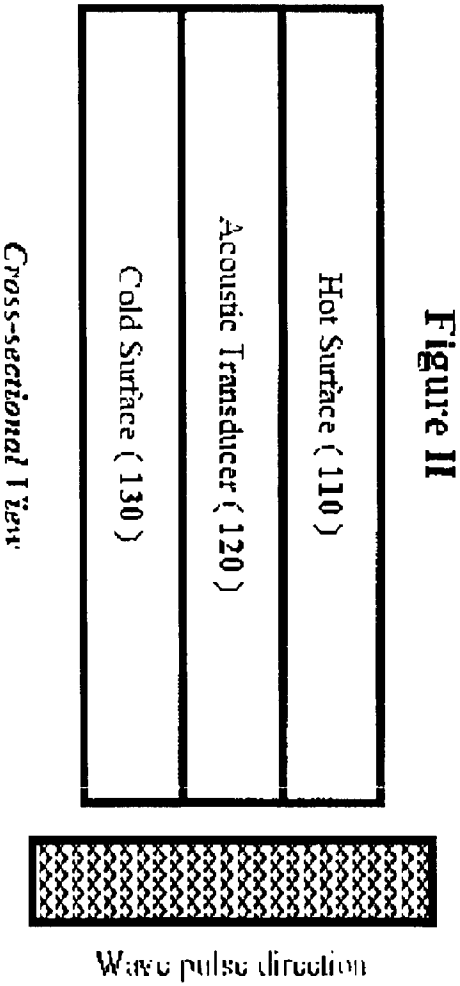
*Cross-sectional View*

Figure III
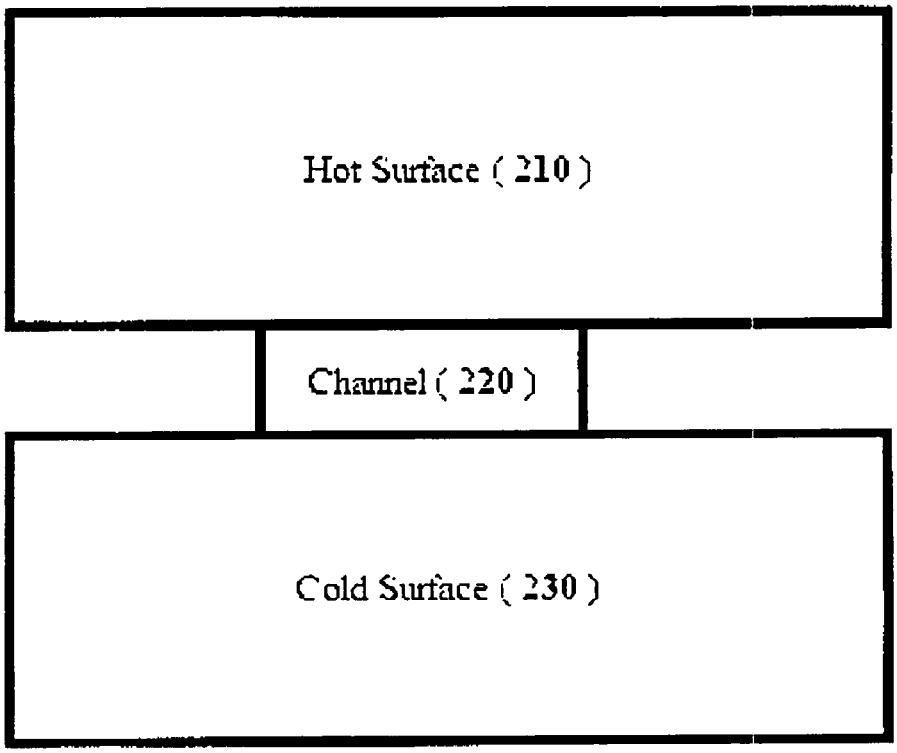
*Cross-sectional View*

ENHANCED ENERGY CONCENTRATOR COMPOSITION

CROSS-REFERENCE TO RELATED APPLICATIONS

This application claims priority from U.S. Provisional Patent Application Ser. No. 60/519,804 filed Nov. 14, 2003 with priority claims and is a continuation-in-part of U.S. Provisional Patent Application Ser. No. 60/391,601 filed Jun. 27, 2002, included as reference only without priority claims.

DESCRIPTION

Background of the Invention

The present invention relates to thermal concentrator compositions and manufacturing methods for enhancing the heat transfer characteristics of any heat exchanger.

The term "conductivity", as used herein, includes thermal conductivity, coefficient of thermal heat transfer, and electrical conductivity in a carrier medium.

Heat exchangers have applications in both heating and cooling, including refrigeration, air conditioning, computer processors, thermal storage systems, heating pipes, fuel cells, solar collectors and concentrators, and hot water and steam systems. Heat exchangers utilize a wide range of design concepts and a further wide range of heat transfer fluids.

The most recognized heat exchanger design concepts are centered on tube, fin, and plate designs most often composed of metals and infrequency composed of polymers. Thermal transfer compositions made of solids have been used alone or in combination with additives, such as metal and carbon additives as polymer matrixes for enhanced thermal conductivity. Such media are used to transfer heat from one body to another, typically from a heat source (e.g., an vehicle engine, boiler, computer chip, or refrigerator), to a heat sink, to effect cooling of the heat source, heating of the heat sink, or to remove unwanted heat generated by the heat source. Heat transfer media provide thermal pathways between a heat source and a heat sink that dissipates the thermal energy. Thermal transfer media may also be integrated into flow systems, such as to improve heat flow or transfer thermal energy to a fluid flow system such as in a radiant heating system.

Several criteria have been used for the design of heat exchangers and the further selection of heat transfer media for specific applications.

Exemplary criteria for heat exchanger designs include the influence of material composition, available heat transfer surface area, manufacturing cost, and application constraints such as space, weight, and thermal performance. Specific material composition parameters include thermal conductivity, directionality of heat transfer, coefficient of thermal expansion, and long-term operational performance when subjected to specific environmental conditions. Heat transfer is widely recognized as a function of surface area, though presently limited to macro scale surface area phenomenon and not nanoscale surface area that in general translates to a larger surface area yields superior heat transfer. The most limiting design constraint for heat exchangers is manufacturing cost, primarily a function of material composition and then manufacturability design. As a result design methodologies have not changed almost regardless of the material composition. Lastly, the past and present inabilities to modify manufacturing methods limits the means are available to address weight, space, and performance constraints.

A variety of materials can be used as electrically conductive media in systems where electrical (electron) flow is to be maximized and resistance is minimized. Such media can benefit from cost effective methods to enhance electrical conductivity. The electrically conductive media may include a filler material that is electrically conductive to enhance the conductivity of the carrier medium.

The present invention provides a new and improved heat exchanger design and composition through the utilization of conductivity enhancement additives and polymer films.

BRIEF DESCRIPTION OF THE DRAWINGS

FIG. I—A cross sectional view depicting multi-layer coatings and electrical field wave pulse direction.

FIG. II—A cross sectional view depicting transducer and acoustic wave pulse direction.

FIG. III—A cross sectional view depicting channel between hot and cold surfaces.

The concept of utilizing very low resistance surface coatings, without being bound by theory, enables energy to be directionally controlled. The preferred surface coating is selected from the group of diamond, diamond film, diamond-like film, high conductivity metal coatings, and high conductivity nanocomposite coatings. The more preferred surface coating is further comprised of multi-layer coatings. The particularly preferred multi-layer coatings are comprised of alternating layers selected from at least two from the group of positive electrical potential electrode (FIG I—20 and 40); negative electrical potential electrode (FIG. I—30); piezoelectric film; intrinsically piezoelectric film; electron or wave propagation film; acoustic coupling film; acoustic mixing film; and thermal barrier film.

The thermal concentrator composition is further comprised of a channel (FIG. III—220) connecting the "hot" side (FIG. I—10 & FIG. III—210) to the "cold" side (FIG. I—50 & FIG. III—230). Channeling energy requires the channel itself to have minimal thermal resistance, as this region becomes the effective bottleneck. The preferred channel is further comprised of a bonding means to achieve benefits including benefits selected from the group of minimizing thermal resistance and differential of coefficient of thermal expansion. The more preferred bonding methods include means selected from the group of reactive foil layer, intercalated metal within a diamond, graphite, or fullerene structure.

The ultrasonic transducer is an ultrasonic transducer (FIG. II—120) that produces surface acoustic waves including waves that travel along the heat transfer surfaces, waves that travel along the direction of thermal gradient, waves that reflect at an angle from the incidence angle of the originating acoustic waves, and waves that propagate from the high thermal energy source (FIG. II—110) into the low thermal energy source (FIG. II—130). The thermal concentrator composition with surface coating is processed by surface modification selected from the group of texturizing, functionalizing, or microetching to enhance one or more properties selected from wettability, hydrophobicity, to hydrophilicity properties.

SUMMARY OF THE INVENTION

The term "nanoscale", as used herein, are particles having a mean average diameter of less than 1 micron meter and more particularly having a mean average diameter of less than 100 nanometers.

The term "nanocomposite", as used herein, are carrier media comprised of nanoscale particles.

The term "directionality", as used herein, refers to the axial flow of electrons or thermal energy in the axial direction and therefore primarily within a specific conductive path.

The term "functionalized", as used herein, refers to means as known in the art including whereby compounds are emulsified to control of hydrophobic, hydrophilic or molecular polarity, or chemically bonded (including hydrogen bonding), and adsorbed.

As used herein, the term "heat transfer" is used to imply the transfer of heat from a heat source to a heat sink, and applies to both heating and cooling (e.g., refrigeration) systems. The heat transfer means includes radiation, convection, conduction, wave propagation, and quantum means such as phonons.

The term "microetching" process combines the advantage of a controlled and locally enhanced (i.e. grain boundary) etch attack with those benefits of etching solutions (i.e. high metal load, constant etch rate, absence of byproducts). At very low etch rates the new process simultaneously creates an optimal "macro- and micro-structure" on the metal surface with dendritic features, therefore providing the increased surface area and reduced interfacial tension.

As used herein, the term "flow path" is used to imply the flow of electrons (i.e., electron transfer) from a cathode to anode.

The term "electric potential", as used herein, represents a voltage differential between two electrodes. The voltage differential yields electron flow from the negative anode to the positive cathode.

The term "structural integrity", as used herein, is the means of maintaining rigidity, shape, and adequate fluid flow during the course of operation. Structural integrity is achieved by providing support structures that can be mounted within the heat exchanger interior or exterior.

The term "reactive foil", as used herein, is a thin film of reactive components that enable the fusing, bonding, or welding of like or dissimilar materials.

The inventive thermal concentrator is a heat exchanger having a surface coating that creates a path having reduced thermal resistance.

Another aspect of the present invention the thermal concentrator has an increased surface area through methods including non-circular exterior in the cross-sectional dimensions, and microetching of surfaces.

Yet another aspect of the invention is a channel connecting the hot side to the cold side. In accordance to the invention, the channel is bonded to the thermal concentrator preferably having the minimum thermal resistance and differential of coefficient of thermal expansion. The channel is further comprised of a range of devices including devices selected from the group of thermoionic, thermoelectric, heat pipe, heat pump, heat exchanger. Stirling engine, acoustic heat pump, solar cell, fuel cell, and microprocessor.

Another aspect of the present invention is the surface coating being characterized by multi-layer coatings.

Yet another aspect of the invention is an externally applied thermal directional bias from the hot side to the cold side.

In accordance with another aspect of the present invention, the inventive thermal concentrator is configured with alternative surface coatings to reduce electrical resistance.

Another aspect of the present invention is an increase in surface area by incorporating modifications including the addition of non-circular exteriors in the cross-sectional dimension.

Yet another aspect of the invention is the electrical concentrator composition is further comprised of a channel connecting the higher voltage side to the lower voltage side.

Without being bound by theory, it is believed that the surface coating(s) provide a path of least resistance as the method to enhance conductivity and energy transfer.

One advantage of the present invention is that the heat exchanger is more efficient, thus leading to reduced size or greater energy efficiency.

Yet another advantage of the present invention is that heat transfer process is greatly accelerated, again thus leading to reduced size.

A further advantage of the present invention derives from the reduced size, thus enabling reduced secondary design issues associated with heat exchanger placement (e.g., reduced drag, packaging size and costs, and weight).

A yet further advantage of the invention is the ability to manufacture cost effectively heat exchangers of a wide range of design shapes, thus not being limited to traditional extrusion processes.

A yet further advantage of the present invention is the potential to turn-on/turn-off heat transfer by engaging/disengaging the transducer(s) or voltage generator(s).

A still further advantage of the present invention is reduced interfacial stress between the material components to enable higher loadings, and increased thermal and electrical conductivity.

Other advantages of the present invention derive from the enhanced thermal capacity of the heat transfer composition, which results in energy consumption reductions by reducing the incoming fluid temperature (in a cooling system) needed to achieve a targeted fluid leaving temperature. Reduction in fluid velocities may also be achieved, thereby reducing friction losses and pressure losses within a circulation pump.

Yet another advantage of the present invention is that the heat transfer coated compound is compatible with a wide range of heat transfer media, including, but not limited to media for applications ranging from engine cooling, heating, air conditioning, refrigeration, thermal storage, and in heat pipes, fuel cells, battery systems, hot water and steam systems, and microprocessor cooling systems.

And yet another advantage of the present invention is that the nanocomposite is the basis for thermoelectric, and electric-thermo conversion systems.

Additional features and advantages of the present invention are described in and will be apparent from the detailed description of the presently preferred embodiments. It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

DETAILED DESCRIPTION OF THE PREFERRED EMBODIMENTS

The inventive thermal and electrical concentrator, hereinafter also referred to as "concentrator" is now set forth as an enhanced energy transfer system whereby the concentrator has superior energy efficiency. The concentrator is comprised of low resistance surface coating elements as a means of enhancing energy transfer between the "hot" and "cold" media. Such "hot" and "cold" media refer to relative temperature differentials between the two media, whereby the "hot" media has a relatively higher temperature than the "cold" media. When addressing electron flow (i.e. "electrical") the energy transfer occurs between the "lower" and "higher"

media, whereby media differences are relative to voltage potential. The process of energy transfer in a traditional concentrator requires such temperature differential (or voltage differential) in order to transfer thermal (or electrical) energy, typically through conduction and convection means and less frequently through radiation means. Thermal transfer of energy through the above conduction, convection, and radiation means are also traditionally considered to be linear transfer mechanisms. One such example is that the thermal transfer between the two media is simply a linear function of temperature differential and thickness of media.

The thermal concentrator composition is a heat exchanger device having a surface coating to create a path having reduced thermal resistance. The period concentrator has increased surface area by methods including the addition of a non-circular exterior in the cross-sectional dimensions. Numerous modifications are anticipated prior to coating the concentrator with the low resistance surface coating. The more preferred concentrator has an increased surface area by including modifications such as incorporating ridges, spiral, and non-linear shapes. The particularly preferred concentrator is further treated with microetching to increase surface area prior to application of surface coating. The specifically preferred concentrator has a microetched surface treatment characterized by surface topography variations of between 10 nanometers and 5000 nanometers. The microetched surface treatment is preferentially further comprised of either an additional or preferred surface coating that is provides both low thermal resistance and at least one benefit selected from the group of limiting oxidation of high surface area, protecting metal and or polymer from breakdown from refrigerant flow, and further enhancing heat distribution.

The concept of utilizing very low resistance surface coatings, without being bound by theory, enables energy to be directionally controlled. The preferred surface coating is selected from the group of diamond, diamond film, diamond-like film, high conductivity metal coatings, and high conductivity nanocomposite coatings. The more preferred surface coating is further comprised of multi-layer coatings. The particularly preferred multi-layer coatings are comprised of alternating layers selected from at least two from the group of positive electrical potential electrode; negative electrical potential electrode; piezoelectric film; intrinsically piezoelectric film; electron or wave propagation film; acoustic coupling film; acoustic mixing film; and thermal barrier film.

The thermal concentrator composition is further comprised of a channel connecting the "hot" side to the "cold" side. Channeling energy requires the channel itself to have minimal thermal resistance, as this region becomes the effective bottleneck. The preferred channel is further comprised of a bonding means to achieve benefits including benefits selected from the group of minimizing thermal resistance and differential of coefficient of thermal expansion. The more preferred bonding methods include means selected from the group of reactive foil layer, intercalated metal within a diamond, graphite, or fullerene structure.

The thermal concentrator is further comprised of an externally applied thermal directional bias from the hot side to the cold side. The externally applied thermal directional bias is induced by means selected from the group of a voltage potential generator across a minimum of two electrodes, an electrostatic field generator, a magnetic force, an electromagnetic force generator, and a minimum of one ultrasonic transducer. The voltage potential generator is further characterized by variable frequency electrical pulses that travel along the direction of thermal gradient.

The ultrasonic transducer is an ultrasonic transducer that produces surface acoustic waves including waves that travel along the heat transfer surfaces, waves that travel along the direction of thermal gradient, waves that reflect at an angle from the incidence angle of the originating acoustic waves, and waves that propagate from the high thermal energy source into the low thermal energy source. The thermal concentrator composition with surface coating is processed by surface modification selected from the group of texturizing, functionalizing, or microetching to enhance one or more properties selected from wettability, hydrophobicity, to hydrophilicity properties.

The invention anticipates the further addition of devices including devices that convert energy (e.g., phonons to electrons, electrons to phonons, phonons and photons to electrons, electrons to photons, etc.), transfer energy through such noted channel, and amplify energy (e.g., raise voltage, raise temperature differential, etc.). The preferred channel is further comprised of a device or combination of devices selected from the group of thermoionic, thermoelectric, heat pipe, heat pump, heat exchanger, Stirling engine, acoustic heat pump, solar cell, fuel cell, and microprocessor. One such more preferred combination of channel devices is a heat pump followed by a thermoionic cell. Numerous other combinations are anticipated as being in series within the channel flow of energy, which does not actually require the channel device to be entirely contained within the channel.

All of the features and benefits detailed above are anticipated in the present invention as being replicated for the purpose and intent of an electrical concentrator. The difference between the thermal and electrical concentrator is principally the substitution of low thermal resistance coatings with low electrical resistance coatings, the substitution of high thermal resistance coatings with high dielectric coatings, and the substitution of doping such coatings have high thermal conductivity additives with high electrical conductivity additives. The resulting concentrator is an electrical concentrator composition with surface coating having a path having with reduced electrical resistance.

The preferred electrical concentrator is further characterized by the same methods referenced above to increase surface area, increase directional control, and thus amplify/concentrate electron flow through a channel. Such modifications include a non-circular exterior in the cross-sectional dimensions to increase surface area including ridges, spiral, and non-linear shapes. The electrical concentrator composition is further comprised of a channel connecting the higher voltage side to the lower voltage side.

The inventive heat exchanger sets forth design principles that acknowledge the non-linear parameters influencing heat transfer. These include, though not limited to, Reynold's number (turbulence, etc.), surface area at a nanoscale, media turbulence (and the proactive generation of turbulence), and settling of conductivity enhancement additives. The relaxation of both design and manufacturing linear constraints results in non-linear, asymmetric, and more efficient heat exchanger designs. Non-linear variations include changes in both the cross-section ("X" and "Y" dimensions) throughout the heat exchanger in addition to changes in the "Z" dimension (which is perpendicular to the X and Y cross-section of the fluid flow channel).

Without intending to limit the scope of the invention, the following examples describe the geometric design of the present heat exchanger invention. The use of the term "film" in the below examples is equivalent to the term "coating". The use of the term "heat exchanger" is one exemplary of a thermal concentrator.

CONCENTRATOR X AND Y DIMENSIONS VARIATION EXAMPLES

Example 1—Variations in X and Y Dimensions

A linear function having varying X and Y dimensions whereby the maximum cross-sectional area is at the region of lowest temperature differential between hot and cold fluid flows;

A non-linear function having varying X and Y dimensions whereby the maximum cross-sectional area is at the region of lowest temperature differential between hot and cold fluid flows; and A non-linear function having varying X and Y dimensions whereby the cross-sectional area is transitioned as a means to minimize thermal gradient within the fluid flow channel.

The inventive concentrator is best manufactured utilizing traditional plastic processing methods and components. One such exemplary is a heat exchanger comprised of a polymer film, which has numerous manufacturing and processing means recognized in the art. The heat exchanger is comprised of polymer films ranging from single-ply to multi-ply films. Furthermore, the multi-ply films may have multiple polymer film layers with the layers having distinct functionality subsequently processed. Heat exchanger fluid channels having a minimal thickness are recognized as a traditional method of maximizing heat transfer by conduction, whereby the smaller thickness reduces thermal resistance. The inventive heat exchanger is optimally comprised of film layers at the nanoscale, without being bound by theory, as a means to obtain heat transfer by the addition of quantum energy transfer. Polymer films are conductive to the non-linear design objectives through manufacturing techniques including, though not limited, vacuum forming and blow-molding. The initial polymer film is manufactured by widely recognized in the art film forming techniques including, though not limited to one step selected from the group of casting into a film, extruding a film, blow-molding a film, or printing onto a polymer film.

Variations in the Z dimension specifically enable the inclusion of conductivity enhancement additives as a means to enhance heat transfer. Conductivity enhancement additives over time, specifically during the absence of operation, tend to settle within the fluid flow channel. The varying cross-section in the Z dimension is a means to minimize any back-pressure created from the settling of additives within the fluid flow, minimize the time required to redisperse any settled additives, and minimizing the amount of additive settlement within any one reservoir. The inventive heat exchanger is comprised of vacated channels having varying dimensions in the Z dimension as a means to optimize heat transfer.

The variations in the Z dimension version of the inventive heat exchanger serves in many distinct roles as detailed in the following examples without intending to limit the scope of the invention.

SINGLE-PLY FILM EXAMPLES

Example 2—Single-Ply Film Roles

Barrier film between hot and cold fluid flow;

Barrier film between hot and cold flows that enables latent energy to pass between barrier film;

Barrier film between sacrificial core and subsequent barrier film, effectively creating a sacrificial core sandwich;

Pliable barrier film between sacrificial core and non-sacrificial core portion;

Pliable barrier film between sacrificial core and subsequent barrier film, effectively creating a sacrificial core sandwich, that is further processed by thermal or ultraviolet to create rigid barrier film;

Pliable film tubes, which is a hollow tube having a pliable barrier film, is filled with a sacrificial core;

Pliable film tubes, which is a hollow tube having a pliable barrier film;

Pliable film tubes filled with sacrificial core and having end-caps;

Rigid film tubes, which is a hollow tube having a pliable barrier film, is filled with a sacrificial core;

Rigid film tubes, which is a hollow tube having a pliable barrier film;

Rigid film tubes having end-caps;

Above sacrificial sandwiches are subsequently stacked to create the heat exchanger;

Above film tubes filled with sacrifical core are subsequently stacked to create the heat exchanger; and Above film tubes with hollow interiors are subsequently stacked to create the heat exchanger, subsequently overmolded with a sacrificial exterior, and finally subsequently overmolded again with a non-sacrificial material.

The multi-ply film version of the inventive heat exchanger serves in many distinct roles as detailed in the following examples without intending to limit the scope of the invention.

MULTI-PLY FILM EXAMPLES

Example 3—Multi-Ply Film Roles

A multi-ply film composite comprised of at least one low thermal resistance layer;

A multi-ply film composite comprised of at least one functional electrode layer;

A multi-play film composite comprised of at least one piezoelectric layer film that produces acoustic waves that propagate from the surface of the heat exchanger into the fluid flow;

A multi-ply film composite comprised of at least one solar collector layer;

A multi-ply film composite comprised of at least one acoustic coupling layer;

A multi-ply film composite comprised of at least one electron propagation layer;

A multi-ply film composite comprised of at least one wave propagation layer;

A multi-ply film composite comprised of at least one thermoelectric layer;

A multi-play film composite comprised of at least one sacrificial core layer;

A multi-ply film composite comprised of at least one adhesion layer to limit any air gaps between subsequent film layers;

A multi-ply film composite comprised of at least one voltage potential generator layer comprised at a minimum of two electrodes and further composed of an electrically conductive nanocomposite. Without being bound by theory, it is believed that electrically conductive nanocomposite additives enable energy transfer through the quantum region whereby electrons convert to phonons, and to waves and other combinations thereof;

Multiple polymer film layers have functionality selected from the group of positive and negative electrical potential through a minimum of two electrodes, generation of acoustic waves through at least one transducer, and piezoelectric film, and film layers that yield at least one from the group of acoustic coupling, acoustic mixing, and electron or wave propagation; and Multiple polymer film layers comprised at least of two layers including a non-porous film impermeable to liquids yet vapor breathable and a Z-direction that transports liquid with one-way flow of liquid with little or no backflow.

ENERGY TRANSFER ACCELERATOR EXAMPLES

Example 4—Means of Accelerating Energy Transfer

A variable frequency generator to produce electrical pulses that travel along the direction of thermal gradient. Without being bound by theory, it is believed that higher frequency pulses accelerate the transfer of energy from the "hot" region to the "cold" region on orders of magnitude greater than conduction and convection energy transfer; and A heat exchanger is comprised of at least one transducer as a means to produce acoustic waves. One such transducer is an ultrasonic transducer coupled to the heat exchanger in order to produce acoustic waves of at least one from the group of surface acoustic waves that travel along the heat exchanger's heat transfer surfaces, surface acoustic waves that travel along the direction of thermal gradient, surface acoustic waves that travel at an angle to the angle of incidence from the originating acoustic waves, and surface acoustic waves that travel along a path whereby the acoustic waves propagate from the high thermal energy source into the low thermal energy source; and The utilization of a series of transducers that produce acoustic waves selected from the group of surface acoustic waves that travel along the heat transfer surfaces; surface acoustic waves that travel along the direction of thermal gradient; surface acoustic waves that reflect at an angle from the incidence angle of the originating acoustic waves; surface acoustic waves that propagate from the high energy source into the low thermal energy source; and acoustic waves that propagate from the surface of the heat exchanger.

The implicit parameter affecting conductivity enhancement performance in surface area. It is anticipated in this invention that the practice as recognized in the art of microetching serves as one means to increase surface area. The increase in surface area in the nanoscale realm requires microetching processes that result in modifying of the surface topography with nanoscale dendritic features. One such means is the usage of hydrophilic organic groups in order to form complexes with the copper of the substrate. The complexes have different chemical stability and solubility in the subsequent process solutions. If a complex is very stable (thermodynamically favored) and insoluble in subsequent process solutions, it can cause etch retardation. Stable complexes in many instances are formed with relatively high molecular weight materials.

The inventive heat exchanger comprised of a nanocomposite, regardless of the manufacturing process of the individual constituents, is blended with a carrier media with said nanocomposite as an additive for a heat exchanger coating and manufactured by means known in the art into a heat exchanger with enhanced surface area. The heat exchanger performs with significantly improved heat transfer characteristics.

Without intending to limit the scope of the invention, the following manufacturing examples describe the manufacturing methods of the present heat exchanger invention. Superior manufacturing methods, such as the ones listed in the following examples are utilized to reduce the manufactured cost of the inventive heat exchanger.

MANUFACTURING EXAMPLES

Example 5—Bonding of Adjoining Film Layers, Concentrator to Channel (and Channel Devices)

Welding of adjoining film layers by electrical discharge, laser, ultrasonic, stir-welding, and thermal welding methods known in the art;

Reactive films as a means of thermally bonding adjoining film layers;

Adhesive bonding utilizing conductive, non-conductive pastes, and nanocomposite pastes;

Example 6—Surface Modification of Film Layers

Texturizing of film surface is known in the art as a means of enhancing adhesion, wettability, hydrophobicity, and hydrophilicity properties;

Functionalizing of film surface is known in the art as a means of enhancing adhesion, wettability, hydrophobicity, and hydrophilicity properties; and Texturizing of film surface is known in the art as a means of increasing surface area and turbulence;

Microetching as means to increase surface area into the nanoscale proportions that in turn results in energy transfer through the quantum region thus enhancing heat transfer properties. The resultant microetching through surface treatment yielding a surface topography with variations between 10 nanometers and 5 microns (5000 nanometers); and Subsequent coating of the microetched surface using a coating comprised of at least one from the group of materials to limit oxidation of high surface area, to protect metal from breakdown from refrigerant flow, and means to enhance heat distribution. One such means to enhance heat distribution is the use of diamond and diamond like coatings that uniquely provide heat transfer without any directionality dependence.

Example 7—Bulk Modification of Film Layers

Cryogenic tempering, without being bound to theory, reduces the interfacial tension at the atomic and molecular level resulting in enhanced strength, conductivity, and heat transfer; and Microetching as means to increase surface area into the nanoscale proportions that in turn results in energy transfer through the quantum region thus enhancing heat transfer properties. The resultant microetching through surface treatment yielding a surface topography with variations between 10 nanometers and 5 microns (5000 nanometers).

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A thermal concentrator comprised of a channel between the hot side to the cold side, wherein said thermal concentrator is comprised of a surface nanocomposite coating having nanoscale particles less than 100 nanometers creating a path having reduced thermal resistance and a multi-layer nanoscale channel wherein at least one layer through the channel connecting a hot side to the cold side is less than 100 nanometers for directional control of the axial flow of electrons or thermal energy within said channel and wherein said channel is further comprised of alternating layers selected from at least two layers from the group consisting of positive electrical potential electrode, negative electrical potential electrode, piezoelectric film, intrinsically piezoelectric film, electron or wave propagation film, acoustic coupling film, acoustic mixing film, and thermal barrier film.

2. The thermal concentrator according to claim 1, wherein the surface nanocomposite coating is an exterior coating further microetched to increase surface area and whereby said microetched coating has surface topography variations between 10 nanometers and 1000 nanometers.

3. The thermal concentrator according to claim 2, wherein the exterior coating is further comprised of at least one coating selected from the group consisting of material to limit oxidation of high surface area, to protect metal from breakdown from refrigerant flow, and means to enhance heat distribution.

4. The thermal concentrator according to claim 1, further comprised of an externally applied thermal directional bias from the hot side to the cold side perpendicular to the thermal gradient whereby said bias is through connecting the hot side to the cold side.

5. The thermal concentrator according to claim 4, wherein bias through the channel connecting the hot side to the cold side is induced by at least one method selected from the group consisting of a voltage potential generator across a minimum of two electrodes, an electrostatic field generator, a magnetic force, an electromagnetic force generator, and a minimum of one ultrasonic transducer.

6. The thermal concentrator according to claim 5, wherein generator creates variable frequency electrical pulses that travel along the direction of thermal gradient.

7. The thermal concentrator according to claim 5, wherein bias is a transducer produced surface acoustic waves whereby said waves travel through the channel connecting the hot side to the cold side including, waves that travel along the direction of thermal gradient, waves that reflect at an angle from the incidence angle of the originating acoustic waves, and waves the propagate from the high thermal energy source into the low thermal energy source.

8. The thermal concentrator according to claim 1, further processed by surface modifications selected from the group consisting of texturizing, functionalizing, or microetching to enhance one or more properties including wettability, hydrophobicity, to hydrophilicity properties.

9. The thermal concentrator according to claim 1, further comprised of a device selected from the group consisting of thermoionic, thermoelectric, heat pipe, heat pump, heat exchanger, Stirling engine, acoustic heat pump, solar cell, fuel cell, and microprocessor.

10. A thermal concentrator wherein at least one layer within a channel between a hot side to a cold side is comprised of altemating layers selected from at least two layers from the group consisting of: positive electrical potential electrode; negative electrical potential electrode; piezoelectric film; intrinsically piezoelectric film; electron or wave propagation film; acoustic coupling film; acoustic mixing film; and thermal barrier film as a means of accelerating the energy transfer between electrons, phonons, electrons to phonons, or phonons to electrons.

11. The thermal concentrator according to claim 10, further comprised of a device selected from the group consisting of thermionic, thermoelectric, heat pipe, heat pump, heat exchanger, Stirling engine, acoustic heat pump, solar cell, fuel cell, and microprocessor.

12. The thermal concentrator according to claim 10, further comprised of transducer produced surface acoustic waves whereby said waves travel through the channel connecting the hot side to the cold side including waves that travel along the direction of thermal gradient, waves that reflect at an angle from the incidence angle of the originating acoustic waves, and waves that propagate from the high thermal energy source into the low thermal energy source.

13. The thermal concentrator according to claim 10, further comprised of a variable frequency pulse bias whereby said pulse travels along the direction of thermal gradient.

14. The thermal concentrator according to claim 10, further comprised of an exterior coating selected from the group consisting of materials to limit oxidation of high surface area, to protect metal from breakdown from refrigerant flow, and means to enhance heat distribution.

15. The thermal concentrator according to claim 10, further comprised of an exterior microetched coating to increase surface area and whereby said coating has surface topography variations between 10 nanometers and 1000 nanometers.

* * * * *